US008229335B2

(12) United States Patent
Nishizaki

(10) Patent No.: US 8,229,335 B2
(45) Date of Patent: Jul. 24, 2012

(54) IMAGE FORMING APPARATUS, IMAGE FORMING METHOD, AND IMAGE FORMING PROGRAM PRODUCT

(75) Inventor: Shingo Nishizaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 141 days.

(21) Appl. No.: 12/831,327

(22) Filed: Jul. 7, 2010

(65) Prior Publication Data

US 2011/0026951 A1 Feb. 3, 2011

(30) Foreign Application Priority Data

Jul. 30, 2009 (JP) ..... 2009-178175
Jun. 3, 2010 (JP) ..... 2010-128061

(51) Int. Cl.
*G03G 15/01* (2006.01)

(52) U.S. Cl. ..... 399/301; 399/302

(58) Field of Classification Search ..... 399/301, 399/302, 298, 299, 223, 39
See application file for complete search history.

(56) References Cited

U.S. PATENT DOCUMENTS 7,133,627 B2 11/2006 Nishizaki
7,706,731 B2 * 4/2010 Martin et al. ..... 399/298
2008/0044195 A1 2/2008 Higashiyama et al.
2010/0303514 A1 * 12/2010 Ishii et al. ..... 399/301
2010/0310285 A1 * 12/2010 Yasumoto ..... 399/302
2010/0322679 A1 * 12/2010 Kobayashi et al. ..... 399/301
2011/0013950 A1 * 1/2011 Furuya et al. ..... 399/302

FOREIGN PATENT DOCUMENTS

JP 07-244414 9/1995
JP 2004-205943 7/2004
JP 2007-295071 11/2007

* cited by examiner

*Primary Examiner* — Sophia S Chen
(74) *Attorney, Agent, or Firm* — IPUSA, PLLC

(57) ABSTRACT

An image forming apparatus, includes a transferring belt where a color image is formed; a conveyance belt transferring a recording medium where a monochrome image is transferred; a velocity difference detecting part detecting a velocity difference between the transferring belt and the conveyance belt; a determining part determining whether the velocity difference detected by the velocity difference detecting part is equal to or greater than a designated value; a velocity adjusting part adjusting the velocity difference so that the velocity difference becomes lower than the designated value in a case where the velocity difference is determined to be the designated value or more by the determining part; and a color correcting part correcting a shift of colors between the color image and the monochrome image by using the transferring belt and the conveyance belt whose velocities are adjusted by the velocity adjusting part.

12 Claims, 12 Drawing Sheets

IMAGE FORMING APPARATUS, IMAGE FORMING METHOD, AND IMAGE FORMING PROGRAM PRODUCT

CROSS-REFERENCE TO RELATED APPLICATIONS

This patent application is based upon and claims the benefit of priority of Japanese Patent Application No. 2009-178175 filed on Jul. 30, 2009 and Japanese Patent Application No. 2010-128061 filed on Jun. 3, 2010, the entire contents of which are incorporated herein by reference.

BACKGROUND OF THE INVENTION

1. Field of the Invention

The present invention generally relates to image forming apparatuses, image forming methods, and image forming program products, and more specifically, to an image forming apparatus such as a copier or a printer configured to form an image on a transferring member such as a recording medium, an image forming method, and an image forming program product.

2. Description of the Related Art

In recent image forming apparatuses such as color copiers or color printers, a color image is output with output velocity the same as that in a case of outputting monochrome images. Therefore, tandem type image forming apparatuses where toner images of plural colors are simultaneously formed have been mainly used.

In the tandem type image forming apparatuses, a photo sensitive body and a developing device of each color are individually provided. Toner images formed on the photo sensitive bodies of respective colors are transferred onto an intermediate transferring belt so that a color image is formed.

On the other hand, an image forming apparatus has been known having a structure where image forming parts of the monochrome image and the color image are separated in order to reduce the output time of the monochrome images in an environment where a proportion of outputting the monochrome images is high.

In the image forming apparatus, in a case where the monochrome image is formed, a black toner image is directly transferred onto a recording sheet so that the monochrome image is formed. In addition, in a case where the color image is formed, after the toner images of the respective colors formed on the belt are transferred onto the recording sheet, the black toner image is transferred onto the recording sheet where the color toner images have been transferred, so that a color image is formed. See, for example, Japan Laid-Open Patent Application Publication NO. 2004-205943.

The above-mentioned image forming apparatus where the image forming parts of the monochrome image and the color image are separated includes an intermediate transferring belt configured to form images of, for example, three colors and a conveyance belt configured to convey the recording sheet where the monochrome image is transferred.

In the above-mentioned image forming apparatus including plural belts, first, a monochrome image is transferred onto the recording sheet situated on the conveyance belt. Then, the images of three colors formed on the intermediate transferring belt are secondarily transferred onto the recording sheet where the monochrome image has been formed, so that the color image is formed.

In a case where a color matching process is performed where a color shift among plural colors is adjusted in the image forming apparatus, according to the related art, for example, first, a four color toner pattern of three chromic colors and one black color are formed on the conveyance belt. A toner pattern of four colors is detected by a sensor so that an amount of shift from a correct position of each color is calculated. In addition, the calculated shift amount is corrected by adjusting the timing of writing positions.

However, it is necessary for a four color toner pattern to be formed on the conveyance belt by using two belts, namely the intermediate transferring belt and the conveyance belt. Accordingly, in a case where belt velocities of these belts are different from each other, although the same length toner pattern is output, not only a shift of a writing position but also a shift in a toner pattern length direction may be generated in the formed toner pattern.

Because of this, in a case where the color matching process is performed, the shift of the toner pattern length due to the difference of the velocities may not be corrected by the correction of the timing of the writing position. Hence, it may not be possible to securely perform color matching of the shift among the colors.

SUMMARY OF THE INVENTION

Accordingly, embodiments of the present invention may provide a novel and useful image forming apparatus, image forming method, and image forming program product solving one or more of the problems discussed above.

More specifically, the embodiments of the present invention may provide an image forming apparatus whereby a difference of velocities of plural belts used for image forming is securely and promptly detected so that the velocities are adjusted and color matching is precisely performed, an image forming method, and an image forming program product.

One aspect of the present invention may be to provide an image forming apparatus, including a transferring belt where a color image is formed; a conveyance belt configured to transfer a recording medium where a monochrome image is transferred; a velocity difference detecting part configured to detect a velocity difference between the transferring belt and the conveyance belt; a determining part configured to determine whether the velocity difference detected by the velocity difference detecting part is equal to or greater than a designated value; a velocity adjusting part configured to adjust the velocity difference so that the velocity difference becomes lower than the designated value in a case where the velocity difference is determined to be the designated value or more by the determining part; and a color correcting part configured to correct a shift of colors between the color image and the monochrome image by using the transferring belt and the conveyance belt whose velocities are adjusted by the velocity adjusting part.

Another aspect of the present invention may be to provide an image forming method implemented by using an image forming apparatus, the image forming apparatus including a transferring belt where a color image is formed and a conveyance belt configured to transfer a recording medium where a monochrome image is transferred, the image forming method including a velocity difference detecting step of detecting velocity difference between the transferring belt and the conveyance belt; a determining step of determining whether the velocity difference detected in the velocity difference detecting step is equal to or greater than a designated value; a velocity adjusting step of adjusting the velocity difference so that the velocity difference becomes lower than the designated value in a case where the velocity difference is determined to be the designated value or more in the determining step; and a color correcting step of correcting a shift of colors between the color image and the monochrome image by using the transferring belt and the conveyance belt whose velocities are adjusted in the velocity adjusting step.

Another aspect of the present invention may be to provide an image forming program product where a program is stored, the program to be executed by a computer to perform an image forming method implemented by using an image forming apparatus, the image forming apparatus including a transferring belt where a color image is formed and a conveyance belt configured to transfer a recording medium where a monochrome image is transferred, the image forming method including a velocity difference detecting step of detecting velocity difference between the transferring belt and the conveyance belt; a determining step of determining whether the velocity difference detected in the velocity difference detecting step is equal to or greater than a designated value; a velocity adjusting step of adjusting the velocity difference so that the velocity difference becomes lower than the designated value in a case where the velocity difference is determined to be the designated value or more in the determining step; and a color correcting step of correcting a shift of colors between the color image and the monochrome image by using the transferring belt and the conveyance belt whose velocities are adjusted in the velocity adjusting step.

According to the embodiments of the present invention, it is possible to provide an image forming apparatus whereby a difference of velocities of plural belts used for image forming is securely and promptly detected so that the velocities are adjusted and color matching is precisely performed, an image forming method, and an image forming program product.

Additional objects and advantages of the embodiments will be set forth in part in the description which follows, and in part will be obvious from the description, or may be learned by practice of the invention. The object and advantages of the invention will be realized and attained by means of the elements and combinations particularly pointed out in the appended claims.

It is to be understood that both the foregoing general description and the following detailed description are exemplary and explanatory only and are not restrictive of the invention as claimed.

DETAILED DESCRIPTION OF THE PREFERRED EMBODIMENTS

A description is given below, with reference to the FIG. 1 through FIG. 12 of embodiments of the present invention.

In the embodiments of the present invention, by using a belt velocity detecting toner pattern formed on a belt used for image forming, it is possible to securely and promptly detect the difference of velocities of an intermediate transferring belt and a conveyance belt with conditions similar to image forming conditions. In addition, after the velocities of the belts are adjusted so that the difference of the belt velocities of these belts becomes less than a designate value, a color matching process is performed. As a result of this, it is possible to securely perform the color matching of the colors.

<Schematic Structure of Image Forming Apparatus>

Figure 1:
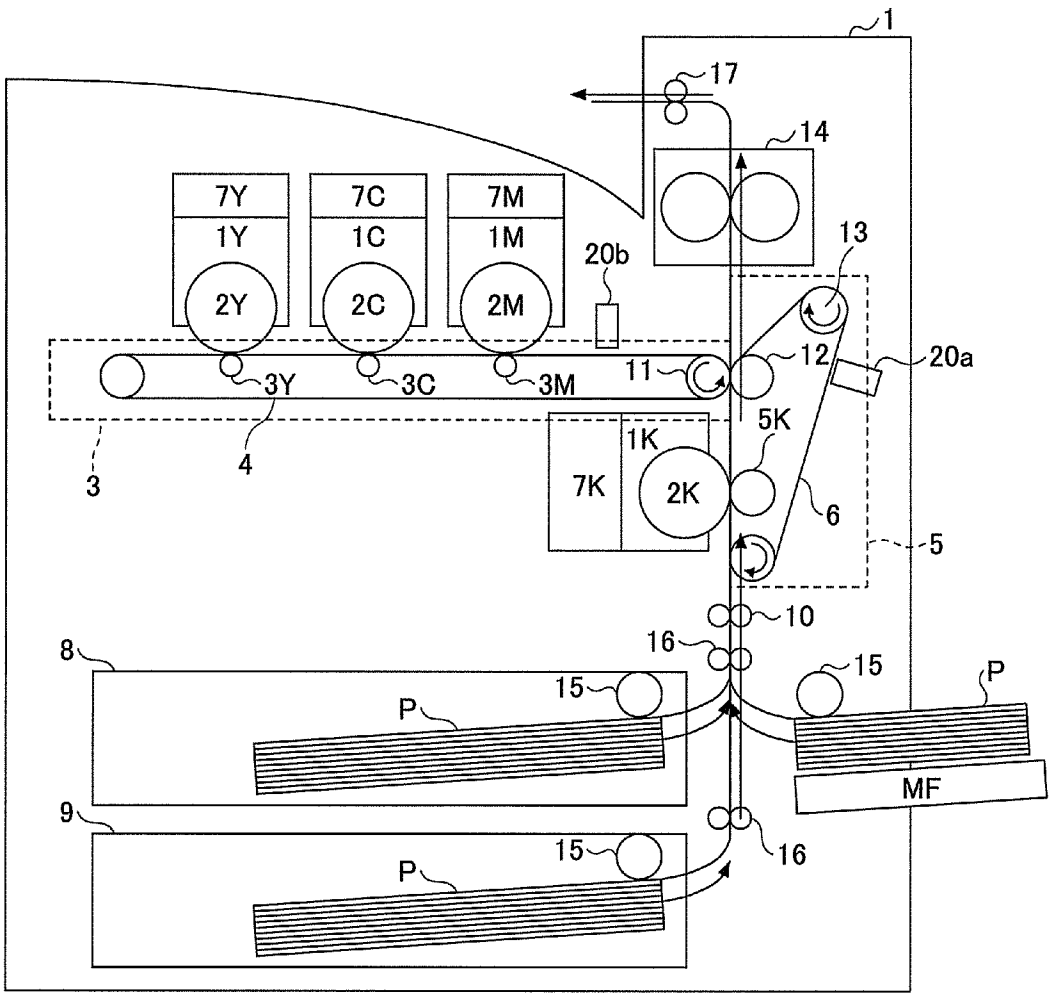
FIG. 1 is a schematic view of an image forming apparatus of an embodiment of the present invention.

FIG. 1 is a schematic view of an image forming apparatus of the embodiment of the present invention. As shown in FIG. 1, an image forming apparatus 1 includes toner image forming parts 1Y, 1C, 1M, and 1K configured to form images of corresponding colors, yellow (Y), cyan (C), magenta (M), and black (K). Hereinafter, references Y, C, M, and K represent members for the corresponding colors, yellow, cyan, magenta, or black. When these are generically named, the references are omitted.

Each of the toner image forming parts 1Y, 1C, 1M and 1K includes a corresponding photosensitive body drum 2Y, 2C, 2M, and 2K as an image carrier and a developing unit. An electrostatic latent image formed on each of the photosensitive body drums 2 is developed with a toner of the corresponding color by using the developing unit so that the toner image of the corresponding color is formed on each of the photosensitive body drums 2.

Intermediate transferring units 3Y, 3C, 3M are provided under the toner image forming parts 1Y, 1C, and 1M of the chromic colors. The intermediate transferring units 3Y, 3C, 3M include an intermediate transferring belt 4 as a transferring belt. The intermediate transferring units 3Y, 3C, 3M are configured to superpose the toner images formed on the photosensitive body drums 2Y, 2C, and 2M and convey the superposed toner image. The toner image forming parts 1Y, 1C, and 1M are arranged, in series, in a belt moving direction of the endless intermediate transferring belt 4 extending substantially horizontally.

The black color toner image forming part 1K is provided independent of the toner image forming parts 1Y, 10, and 1M provided on the intermediate transferring belt 4. The black color toner image forming part 1K is provided in an upstream position in the moving direction of the recording sheet P as a recording medium.

A direct transferring unit 5K is provided in a position facing the black color toner image forming part 1K. The direct transferring unit 5K is configured to directly transfer the black color toner image onto the recording sheet P. An endless conveyance belt 6 is provided inside the direct transferring unit 5K so as to convey the recording sheet P. The moving direction of the conveyance belt 6 is arranged so as to cross the moving direction of the intermediate transferring belt 4 substantially perpendicularly.

One of the intermediate transferring belt 4 and the conveyance belt 6 is used for forming a belt velocity detecting toner pattern at a belt velocity adjusting process time or forming a color matching process toner pattern at a color matching process time.

The image forming apparatus 1 includes, in addition to the above-mentioned image forming part, optical writing units unit 7Y, 7C, 7M, 7K, a sheet feeding cassette 8, a sheet feeding cassette 9, a manual tray MF, a resist roller pair 10, and others, The optical writing units 7Y, 7C, 7M, 7K are arranged above the toner image forming part 1. The sheet feeding cassette 8, the sheet feeding cassette 9, and the manual tray MF are configured to feed the recording sheets P. The resist roller pair 10 is situated in a position where the recording sheet P being conveyed to the conveyance belt 6 stops for a time.

The image forming apparatus 1 includes a driving roller 11, a secondary transferring roller 12, a driving roller 13, a fixing unit 14, and others. The driving roller 11 is configured to drive the intermediate transferring belt 4. The secondary transferring roller 12 is positioned so as to face the driving roller 11. The driving roller 13 is configured to drive the conveyance belt 6. The fixing unit 14 is configured to fix the toner image transferred onto the recording sheet P.

Each of the optical writing units 7Y, 7C, 7M, 7K includes a light source, a polygon mirror, a f-θ lens, a reflection mirror, and others (not illustrated). Each of the optical writing units 7Y, 7C, 7M, 7K irradiates a laser light, based on image data, onto a surface of each of the photosensitive body drums 2 while each of the optical writing units 7Y, 7C, 7M, 7K scans, and thereby an electrostatic latent image is formed on each of the photosensitive body drums 2.

An arrow extending from each of the sheet feeding cassette 8, the sheet feeding cassette 9, and the manual tray MF to an outside of the image forming apparatus 1 represents a conveyance path of the recording sheet P to be conveyed. The recording sheet P is conveyed by the sheet feeding roller 15 from the sheet feeding cassette 8, sheet feeding cassette 9, or the manual tray MF so as to be conveyed to the resist roller pair 10 by the conveyance roller 16 while being guided by a conveyance guide (not illustrated) and then stops for a time.

At this time, between the conveyance roller 16 and the resist roller pair 10, the recording sheet P stops for a time while the recording sheet P has a certain sag. After that, the recording sheet P is sent out at a designated timing by the resist roller pair 10.

In a case of the monochrome printing where the monochrome image is output, the recording sheet P sent out from the resist roller pair 10 is conveyed by the conveyance belt 6. The black toner image formed by the toner image forming part 1K is transferred to the recording sheet P to be conveyed by a transferring electric field of the transferring roller 5K or application of pressure at a nip.

In a case of the color printing where an a color image is output, the toner images of plural chromatic colors (Y, C, M) superposed on the intermediate transferring belt 4 are transferred onto the recording sheet P conveyed by the conveyance belt 6 by a transferring electric field of the secondary transferring roller 12 or the application of the nip pressure. At this time, since the black toner image is already transferred onto the recording sheet P to be conveyed, by transferring the superposed toner image of plural chromatic colors, a full color toner image is formed on the recording sheet P.

A fixing process is applied to the recording sheet P where the full color toner image is formed by the fixing unit 15 and then the recording sheet P is discharged, by a sheet discharge roller pair 17, to the outside of the image forming apparatus 1.

Thus, in order to form the full color toner image on the recording sheet P so that the color image is formed, plural belts including the intermediate transferring belt 4 and the conveyance belt 6 are used.

At the time of the monochrome printing, the driving roller 11 and the secondary transferring roller 12 are separated from each other so that the driving roller 11 and the toner image forming parts 1*y*, 1C, and 1M are cut off from the driving of the conveyance belt 6. Because of this, it is possible to make the service lifetime of the intermediate transferring belt 4 and the photosensitive body drums 2Y, 2C, and 2M long. In addition, the monochrome printing is performed by minimum driving and therefore it is advantageous from the view points of energy saving, noise reduction, and others.

<Schematic Structure of Transferring Part>

Figure 2:
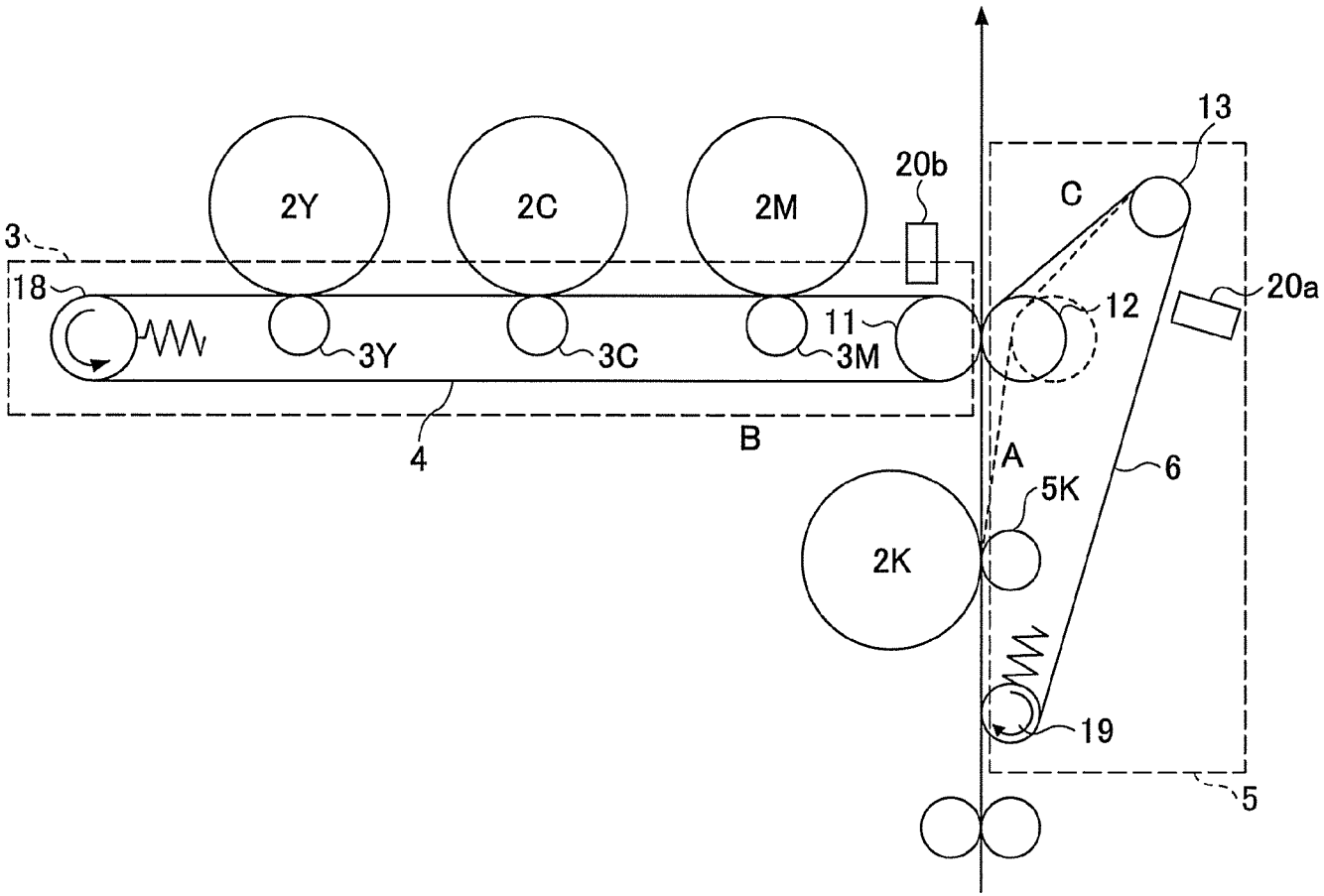
FIG. 2 is a schematic view of a transferring part of the embodiment of the present invention.

FIG. 2 is a schematic view of the transferring part of the embodiment of the present invention. As shown in FIG. 2, the intermediate transferring belt 4 is stretched between the driving roller 11 and the tension roller 18 in a tensioned state. Furthermore, the conveyance belt 6 is laid in a tensioned state by the driving roller 13, the secondary transferring roller 12, and the tension roller 19. As discussed above, in the case of the monochrome printing, the conveyance belt 6, together with the secondary transferring roller 12, is moved to a position indicated by one dotted line in FIG. 2.

For example, when a belt velocity adjusting process or a color matching process of the embodiment of the present invention is performed, the belt velocity detecting toner pattern or the color matching process toner pattern is formed on the intermediate transferring belt 4 or the conveyance belt 6.

As shown in FIG. 2, a toner mark sensor 20*a* is provided at a downstream side of the conveyance belt 6. The toner mark sensor 20*a* is, for example, an optical reflective type sensor. The toner mark sensor 20*a* is configured to detect existence of, for example, the belt velocity detecting toner pattern formed on the conveyance belt 6, as an amount of change of reflection light.

For example, when the conveyance belt 6 is rotated so that the belt velocity detecting toner pattern formed on the conveyance belt 6 passes through the toner mark sensor, a time interval of the toner pattern detected by the toner mark sensor 20*a* is measured so that the difference of the velocities between the intermediate transferring belt 4 and the conveyance belt 6 is calculated.

Here, an example where the belt velocity detecting toner pattern is formed on the conveyance belt 6 is discussed. First, a toner pattern of at least one chromatic color (for example, Y) among plural chromatic colors (for example, Y, C, and M) forming the color image and a toner pattern of a black (K) color forming the monochrome image are output on the corresponding photosensitive body drums 2.

The toner pattern of the chromatic color output on the corresponding photosensitive body drum 2 is transferred onto the intermediate transferring belt 4. The black toner pattern is directly transferred onto the conveyance belt 6. For example, as shown in FIG. 2, the black toner pattern is transferred in a position A on the transferring belt 6 and the chromatic color toner pattern is transferred in a position B on the intermediate transferring belt 4.

The chromatic color toner pattern transferred on the intermediate transferring belt 4 is transferred onto the conveyance belt 6 by the secondary transferring part. Accordingly, in a position C indicated in FIG. 2, the chromatic color toner pattern and the black toner pattern are both provided on the conveyance belt 6 so that the belt velocity detecting toner pattern is formed.

A toner mark sensor 20*b* is provided in a position facing the intermediate transferring 4. Accordingly, the difference of the velocities of the intermediate transferring belt 4 and the conveyance belt 6 may be detected by forming the belt velocity detecting toner pattern on the intermediate transferring belt 4 and detecting the toner pattern with the toner mark sensor 20*b*.

In addition, since the toner mark has been directly transferred onto each of the belts at the belt velocity adjusting time, sheet feeding is not performed. The belt velocity detecting toner pattern of the embodiment of the present invention is formed on the belts with the same conditions as normal image forming conditions except that the sheet feeding is not performed.

Therefore, according to the embodiment of the present invention, the velocities of plural belts are not detected for every belt by the toner pattern generated at the corresponding belt. Rather, by using the belt velocity detecting toner pattern formed at one of the intermediate transferring belt 4 and the conveyance belt 6, it is possible to detect the velocities of the belts under the conditions similar to the image forming conditions.

<Block Diagram of the Image Forming Apparatus>

Figure 3:
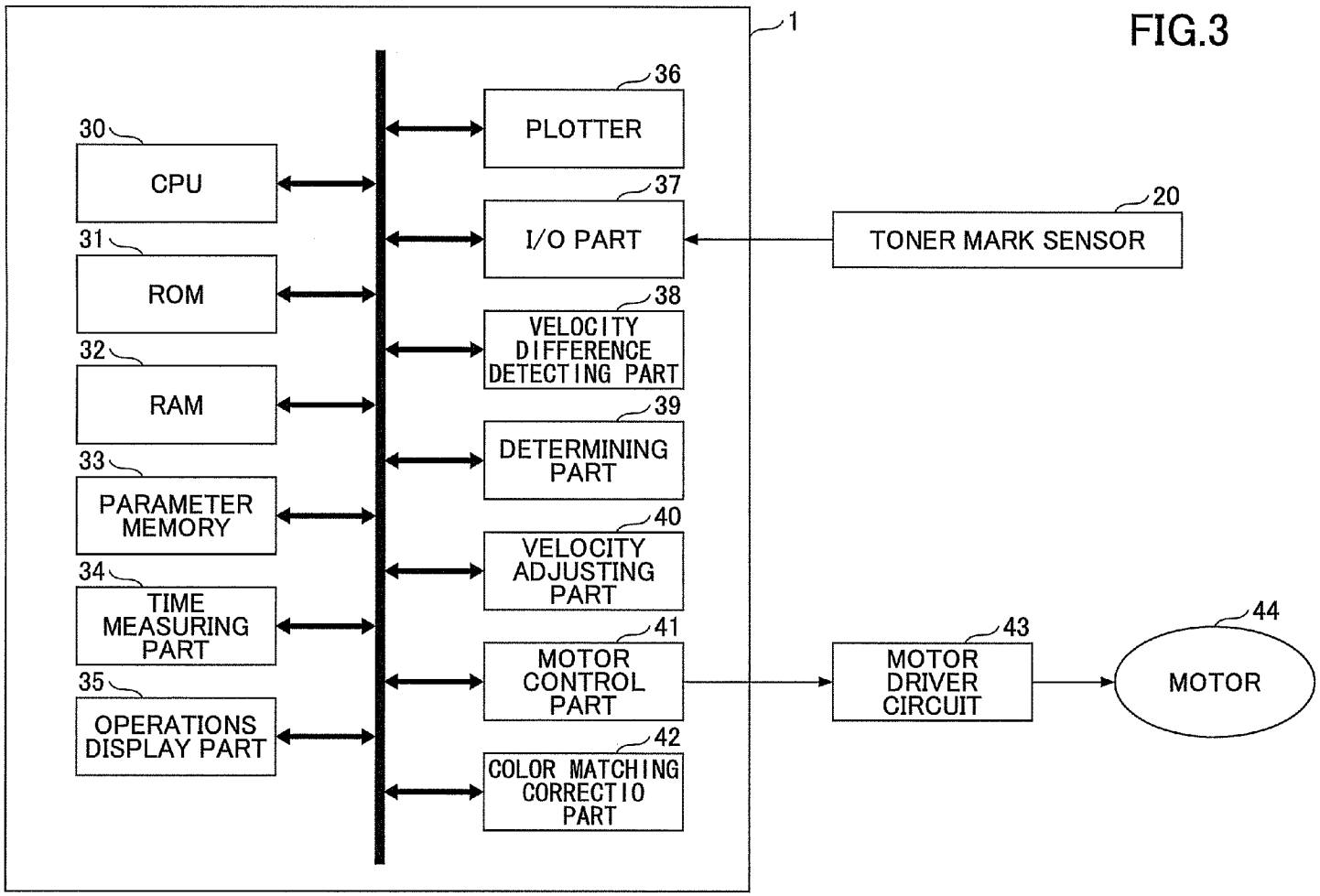
FIG. 3 is a block diagram of the image forming apparatus of the embodiment of the present invention.

Next, a block diagram of the image forming apparatus of the embodiment of the invention is discussed with reference to FIG. 3. FIG. 3 is the block diagram of the image forming apparatus of the embodiment of the present invention.

As shown in FIG. 3, the image forming apparatus 1 includes a CPU (Central Processing Unit) 30, a ROM (Read Only Memory) 31, a RAM (Random Access Memory) 32, a parameter memory 33, a time measuring part 34, an operations display part 35, a plotter 36, an I/O part 37, a velocity difference detecting part 38, a determining part 39, a velocity adjusting part 40, a motor control part 41, and a color matching correction part 42.

The CPU 30 implements a program stored in the ROM 31 so that control of the parts of the apparatus is performed.

The ROM 31 stores the program for performing the control of the parts of the apparatus and fixed data used for the control. The ROM 31 stores, for example, information of the belt velocity detecting toner pattern used for adjusting the velocity of the belts.

The RAM 32 is used so that an image to be printed or an operations area is developed at the time when the program for the control of each of the parts of the apparatus is implemented.

For example, the belt velocity adjusting program of the embodiment stored in the ROM 31 is read out by the CPU 30 and is implemented by using the RAM 32 as a work area.

The parameter memory 33 is a nonvolatile memory where data are stored, whose contents are maintained at the time of electric power shutting down and referred at the next operating time among the data related to the operation of the apparatus. The parameter memory 32 is formed of, for example, EEPROM or SRAM with battery backup.

A parameter such as the number of times repeating the belt velocity detecting toner pattern or the color matching process toner pattern or data renewed at the time when color matching correction of the correction amount of the color shirt or the like is performed is stored in the parameter memory 32.

The time measuring part 34 uses a clock of an inside of a system (system clock). The time measuring part 34 is configured to measure, for example, a time interval of the patterns in the belt velocity adjusting process and a time period that has passed after the color matching process is performed. The time measuring part 34 is a clock function whereby a time is measured. The time when the color matching process is performed is measured so that the time period that has passed after the color matching process is performed based on the difference is known between the present time and the time when the color matching process has been performed.

The operations display part 35 includes operations keys, a display part, and others. The operations keys are used when a user performs settings or the like of the apparatus. The display part is, for example, a liquid crystal display configured to display an operating state of the apparatus or a message by the user.

The plotter 36 is a device configured to form an image on the recording sheet P for outputting. The plotter 36 outputs the belt velocity detecting toner pattern and the color matching process toner pattern of the embodiment of the present invention onto each of the photosensitive body drums 2.

The I/O part 37 includes an input and output port. The I/O part 37 performs input and various kinds of control output of the toner mark sensor 20 and other sensors.

The toner mark sensor 20, as discussed above, detects the color matching process toner pattern and the belt velocity detecting toner pattern formed on the corresponding one of the intermediate transferring belt 4 and the conveyance belt 6. In a case where the toner mark sensor 20 is, as discussed above, the optical sensor, the light is irradiated on the intermediate transferring belt 4 or the conveyance belt 6 so that the toner mark sensor 20 detects reflection light from the toner pattern formed on the intermediate transferring belt 4 or the conveyance belt 6. Information of the detected toner pattern is stored in, for example, the ROM 31 or the like.

In a case where the belt velocity detecting toner pattern is formed on the intermediate transferring belt 4 in this embodiment, compared to a case where a chromatic color toner pattern is transferred onto the conveyance belt 6, reproducibility of the toner pattern is improved. Hence, it is possible to improve the precision of detecting of the toner mark sensor 20.

The velocity difference detecting part 38 is configured to detect the velocity difference between the intermediate transferring belt 4 and the conveyance belt 6 by using the belt velocity detecting toner pattern formed on, by the toner image forming part 1, one of the intermediate transferring belt 4 and the conveyance belt 6.

More specifically, the velocity difference detecting part 38 obtains information of the belt velocity detecting toner pattern detected by the toner mark sensor 20 and stored in the ROM 31, calculates the velocities of the intermediate transferring belt 4 and the conveyance belt 6, and detects the belt velocity difference between the intermediate transferring belt 4 and the conveyance belt 6. A detecting method of the velocity difference is discussed below.

Here, the belt velocity detecting toner pattern includes a toner pattern of at least one chromatic color (for example, Y) among plural chromatic colors (for example, Y, C, and M) forming the color image and a toner pattern of a black (K) color forming the monochrome image.

At this time, the chromatic color toner pattern and the black toner pattern are formed so as to not be overlapped on the intermediate transferring belt 4 or the conveyance belt 6. For example, the chromatic color toner pattern and the black toner pattern may be formed in parallel with a conveyance direction of the intermediate transferring belt 4 or the conveyance belt 6.

By forming the chromatic color toner pattern and the black toner pattern as discussed above, even if there is a difference of the belt velocities between the intermediate transferring belt 4 and the conveyance belt 6, it is possible to form the chromatic color toner pattern and the black toner pattern so as not to be overlapped.

Since the outputs of the toner mark sensor 20 have overlapped wave forms when the chromatic color toner pattern and the black toner pattern are overlapped, it may be possible to solve a problem where the toner pattern is not detected nor to securely detect the velocity difference of the belts.

In addition, by forming a toner pattern with at least one chromatic color (for example, Y) among plural chromatic colors (for example, Y, C, and M), it is possible to reduce a time for forming a toner pattern of other chromatic colors so as to reduce the amount of toner to be used. In addition, it is possible to immediately detect the velocity difference between the two belts.

In order to form the toner pattern of the chromatic color and the toner pattern of the black color so that the toner pattern of the chromatic color and the toner pattern of black color are not overlapped, the toner pattern of the chromatic color and the toner pattern of black color may be formed in a position continuing the conveyance direction of the intermediate transfer belt 4 or the conveyance belt 6, and a designated gap in the conveyance direction is provided between the toner pattern of the chromatic color and the toner pattern of the black color toner formed in the continuing position.

In addition, the toner pattern of the chromatic color may be formed on the intermediate transferring belt 4 in the case of only monochrome printing. With this structure, in the case of only monochrome printing, by detecting the belt velocity of the intermediate transferring belt 4 by using the toner pattern of the formed chromatic color, it is possible to reduce the belt velocity difference detecting time so as to reduce the belt velocity adjusting time.

In addition, it is possible to reduce further a time for forming the toner pattern by forming the toner pattern of one chromatic color among the plural chromatic colors by using the toner image forming part 1 provided at a most downstream side of the intermediate transferring belt 4 (most forward in the conveyance direction).

The velocity difference detecting part 38 may detect the velocity difference by using, as the belt velocity detecting toner pattern, a horizontal toner pattern among the color matching process toner patterns. With this structure, it is not necessary to provide the belt velocity detecting toner pattern in the belt velocity adjusting process. Therefore, it is possible to reduce a time of the belt velocity adjusting process.

The colors of the belt velocity detecting toner pattern are not limited to the above-mentioned Y, C, M, and K. The belt velocity detecting toner pattern may be formed by using a toner pattern of plural colors forming an image.

The determining part 39 is configured to determine whether the velocity difference detected by the velocity difference detecting part 38 is equal to or greater than a designated value set in advance. Here, the designated value set in advance may be a value corresponding to a velocity difference whereby the amount of color shift due to the velocity difference between the belts becomes equal to or less than the amount of color shift acceptable in the output image.

In a case where the velocity difference between the intermediate transferring belt 4 and the conveyance belt 6 is determined, by the determining part 39, to be equal to or greater than the designated value, the velocity adjusting part 40 adjusts the intermediate transferring belt 4 and/or the conveyance belt 6 so that the velocity difference of the intermediate transferring belt 4 and the conveyance belt 6 is cancelled and the velocities of the intermediate transferring belt 4 and the conveyance belt 6 are consistent with each other.

For example, the velocity adjusting part 40 adjust the velocity of the intermediate transferring belt 4 so as to be consistent with the velocity of the conveyance belt 6. As a result of this, it is possible to cancel the velocity difference between the intermediate transferring belt 4 and the conveyance belt 6 without changing the velocity relationship of sheet feeding and sheet discharging based on the change of the velocity of the conveyance belt 6.

The velocity adjusting part 40 is configured to transfer a signal to a motor control part 41 so as to adjust the rotational speed of a motor 44 controlled by the motor control part 41. Two of the motors 44 are configured to respectively rotate the intermediate transferring belt 4 and the conveyance belt 6. The signals are configured to control the rotational speeds of the motors 44. A velocity adjusting method for adjusting the velocity difference between the intermediate transferring belt 4 and the conveyance belt 6 is discussed below.

The velocity adjusting part 40 may control the motor control part 41 so that the velocity difference between the intermediate transferring belt 4 and the conveyance belt 6 becomes lower than the designated value. More specifically, the motor control part 41 controls the velocity of both of the belts so that a difference between the actual velocities and designated object velocities being set for the intermediate transferring belt 4 and the conveyance belt 6 is in a certain range (such as equal to less than 0.05%).

The velocity adjusting part 40 performs the velocity adjustment before the color matching process where a color shift between the plural chromatic colors and the black color is reduced, so that the color matching process is performed in a state where the velocity difference between the intermediate transferring belt 4 and the conveyance belt 6 is cancelled. As a result of this, it is possible to securely perform color matching.

The motor control part 41 is configured to output, via a motor driver circuit 43, a driving signal to each of the motors 44 respectively configured to drive the intermediate transferring belt 4 and the conveyance belt 6. The motor control part 41 outputs, based on the control signal transmitted from the velocity adjusting part 40, a driving signal configured to control the belt velocity of each of the intermediate transferring belt 4 and the conveyance belt 6. As discussed above, the adjustment of the belt velocity may be performed on only one of the intermediate transferring belt 4 and the conveyance belt 6.

After the velocities of the intermediate transferring belt 4 and the conveyance belt 6 are adjusted by the velocity adjusting part 40, the color matching correction part 42 uses the intermediate transferring belt 4 and the conveyance belt 6 whose velocities are adjusted so that the color shift between the color image formed by the toner of the chromatic colors and the monochrome image formed by the toner of the black color is reduced (the colors are matched).

The system bus is a signal line configured to exchange data by the above-mentioned parts. More specifically, the system bus is formed as an aggregation of, for example, a data bus, an address bus, a control bus, an I/O bus, and others.

Next, an example of the belt velocity detecting toner pattern used for the belt velocity adjusting process of the embodiment is discussed. The belt velocity detecting toner pattern is generated in order to detect the belt velocity in, for example, the belt velocity adjusting process before the color matching process.

The belt velocity detecting toner pattern, as discussed above, includes a toner pattern of at least one chromatic color (for example, Y) among plural chromatic colors (for example, Y, C, and M) forming the color image and a toner pattern of a black (K) color forming the monochrome image. Here, the toner pattern includes at least one or more toner marks.

<Example of First Belt Velocity Detecting Toner Pattern>

Figure 4:
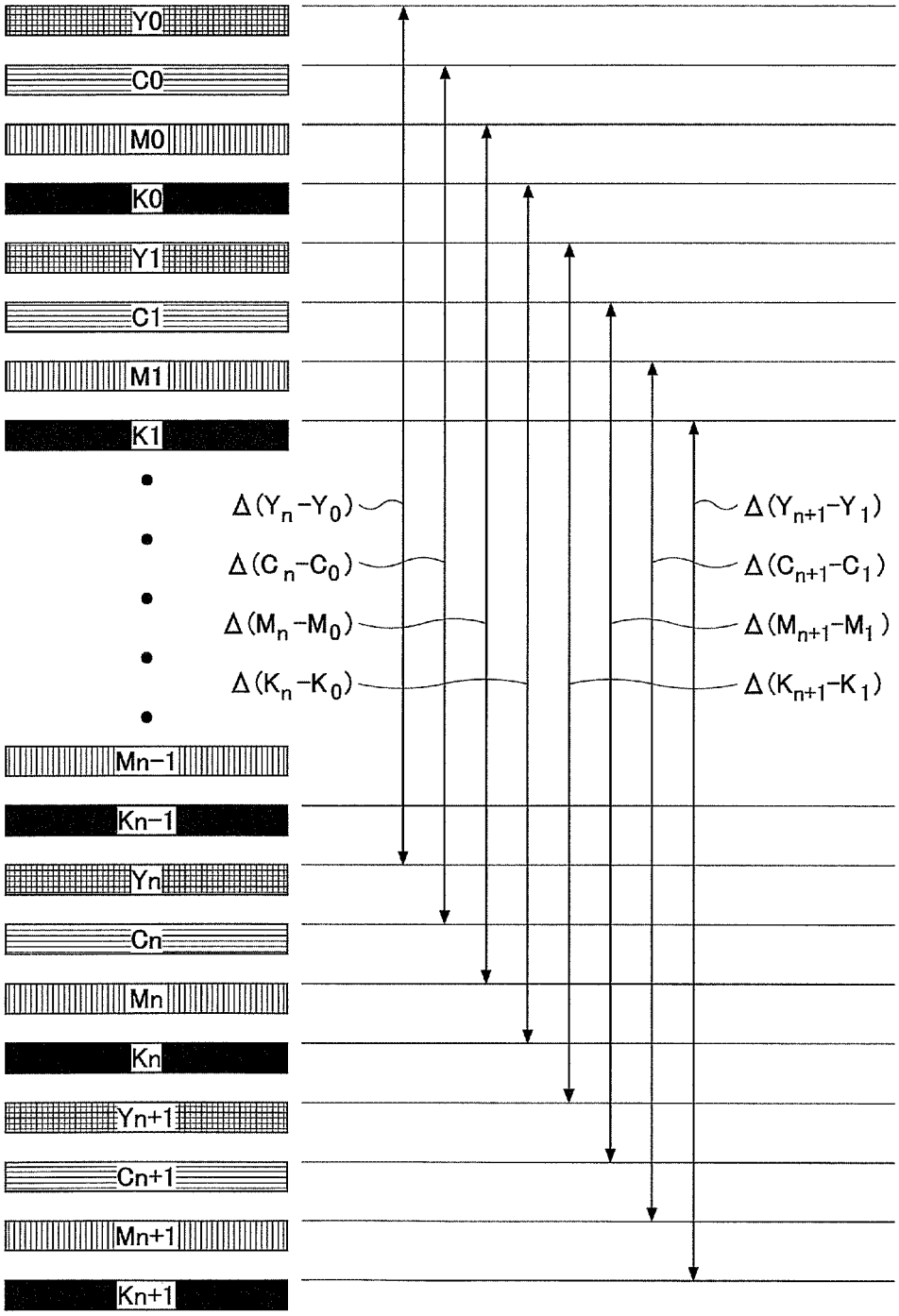
FIG. 4 is a view showing an example of a first belt velocity detecting toner pattern of the embodiment of the present invention.

FIG. 4 is a view showing an example of a first belt velocity detecting toner pattern of the embodiment of the present invention.

As shown in FIG. 4, the first belt velocity detecting toner pattern is formed where the designated number of horizontal toner marks of each of colors Y, C, M and K, is output and the toner marks are repeatedly and closely arranged with a certain gap in a sub-scanning direction such as $Y_0$, $C_0$, $M_0$, $K_0$, . . . , $M_{n-1}$, $K_{n-1}$, $Y_n$.

The velocity difference detecting part 38 uses two toner marks for each color in the first belt velocity detecting toner pattern so that the belt velocity of the intermediate transferring belt 4 and the conveyance belt 6 is calculated.

For example, a time ΔT required for the same color toner patterns $Y_0$ and $Y_n$ formed on the belt to pass the toner mark sensor 20*a* is measured by the time measuring part 34. The velocity difference detecting part 38 divides an output pattern interval $\Delta(Y_n-Y_0)$ set in advance by the passing time ΔT.

As shown in FIG. 4, plural toner marks of each color may be output and toner pattern gaps of plural portions such as a $1^{st}$ toner pattern and a Nth toner pattern of each color and a $2^{nd}$ toner pattern and N+1th pattern may be calculated so that an averaging process is performed. Because of this, an error such as noise can be minimized.

In addition, in a case where the gap of the chromatic color toner pattern and the gap of the black color toner pattern is the same, that is $\Delta(Y_n-Y_0)=\Delta(K_n-K_0)$, the velocity difference between the intermediate transferring belt 4 and the conveyance belt 6 may be calculated by comparing the difference of the passing times ΔT of the chromatic color toner pattern and the black color toner pattern.

The velocities of the intermediate transferring belt 4 and the conveyance belt 6 are slightly changed at a cycle of a single rotation of the driving rollers 11 and 13 due to influence of deflection of the driving rollers 11 and 13, respectively. Thus, change of the conveyance velocity of the belts is made with the cycle of the single rotation of the corresponding driving rollers 11 and 13. Similarly, a deflection of the photosensitive drum 2 influences the velocity of the corresponding belts. The velocity of each of the belts is slightly changed at a cycle of the corresponding photosensitive body drum 2.

In order to eliminate this influence so that the velocity of the belt is calculated precisely, a gap of the velocity detecting patterns (for example, $\Delta(K_{n+1}-K_1)$ in the example shown in FIG. 4) may have a length of an integral multiple of the perimeter of a single rotation of the driving roller 13 or a length of an integral multiple of the perimeter of a single rotation of the photosensitive body drum 2.

The gap of the velocity detecting patterns (for example, $\Delta(K_{n+1}-K_1)$ in the example shown in FIG. 4) may have a length of a common multiple of the perimeter of the single rotation of the driving roller 13 and the perimeter of the single rotation of the photosensitive body drum 2. With this structure, it is possible to eliminate the effect of the deflections of the driving roller 13 and the photosensitive body drum 2, so that the velocity of the belt can be precisely calculated.

<Example of Toner Pattern Formed in a Case where there is the Velocity Difference or there is not the Velocity Difference>

Figure 5:
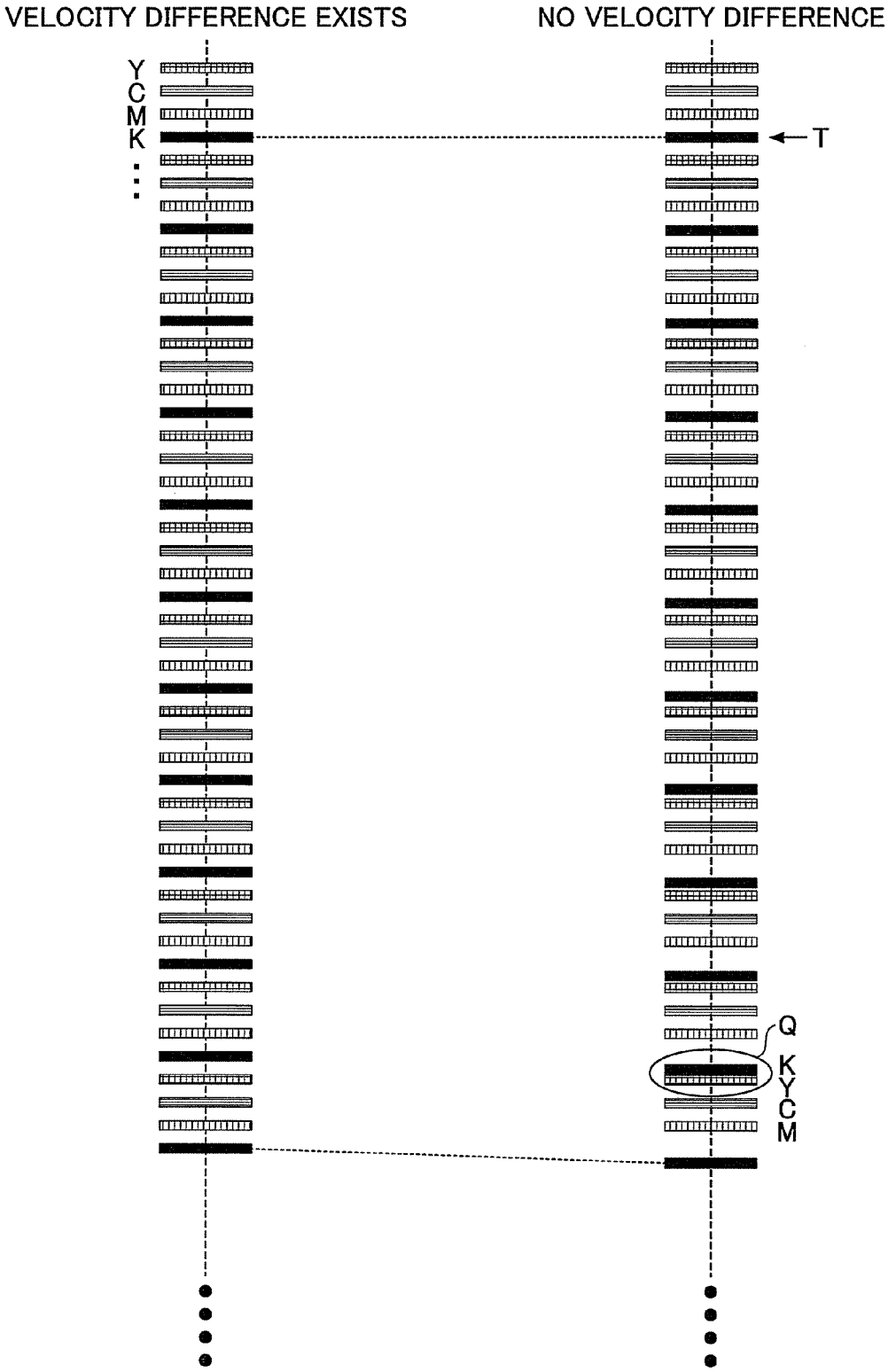
FIG. 5 is a view showing a toner pattern formed in a case where there is difference of velocities of two belts and a toner pattern formed in a case where there is no difference of the velocities of two belts.

Here, a belt velocity detecting toner pattern formed in a case where there is the belt velocity difference between the intermediate transferring belt 4 and the conveyance belt 6 is discussed with reference to FIG. 5. FIG. 5 is a view showing a toner pattern formed in a case where there is the velocity difference of two belts.

As discussed above, one of the toner pattern of the chromatic color output on the intermediate transferring belt 4 and the toner pattern of the black color output on the conveyance belt 6 is transferred onto the other of the intermediate transferring belt 4 and the conveyance belt 6, so that the belt velocity detecting toner pattern is formed.

As shown in FIG. 5, in a case where there is no belt velocity difference between the intermediate transferring belt 4 and the conveyance belt 6, the first belt velocity detecting toner pattern shown in FIG. 4 is formed by a toner pattern being output where, for example, there is a certain gap among Y, C, M, and K.

In a case where there is the velocity difference between the intermediate transferring belt 4 and the conveyance belt 6 equal to or greater than a designated value, when one of the toner pattern of the chromatic color output on the intermediate transferring belt 4 and the toner pattern of the black color output on the conveyance belt 6 is transferred onto the other of the intermediate transferring belt 4 and the conveyance belt 6, the first belt velocity detecting toner pattern may be formed in an overlapped manner.

For example, in a case where the conveyance belt 6 where the toner pattern of the black color is transferred is slower than the intermediate transferring belt 4 where the toner pattern of the chromatic color is transferred, the first belt velocity detecting toner pattern formed on the belt (the intermediate transferring belt 4 or the conveyance belt 6) is formed where the position of the toner pattern of the black color is gradually shifted against the toner pattern of the chromatic color.

As shown by arrow T in FIG. 5, in a write starting position of the toner pattern, the toner pattern of the black color and the toner pattern of the chromatic color are formed with a certain gap without being overlapped. However, by repeatedly outputting the toner patterns, as indicated by an ellipse Q in FIG. 5, the toner pattern of the black color and the toner patter of a yellow color are overlapped.

In other words, in a case where there is the velocity difference between two belts equal to or greater than the designated value, the belt velocity detecting toner pattern may be formed where the toner pattern formed on one of the belts and the toner pattern formed on another of the belts are overlapped.

Thus, the belt velocity detecting toner pattern where the toner patterns are overlapped has a wave-shaped configuration where outputs relative to the amount of the reflection light detected by the toner mark sensor 20 are output. Hence, it is not possible to precisely detect the position of the toner pattern. Accordingly, since the velocity difference between two belts cannot be precisely detected, the velocity adjustment may not be precisely done.

Because of this, for example, a belt velocity detecting toner pattern discussed below is formed.

<Example of Second Belt Velocity Detecting Toner Pattern>

Figure 6:
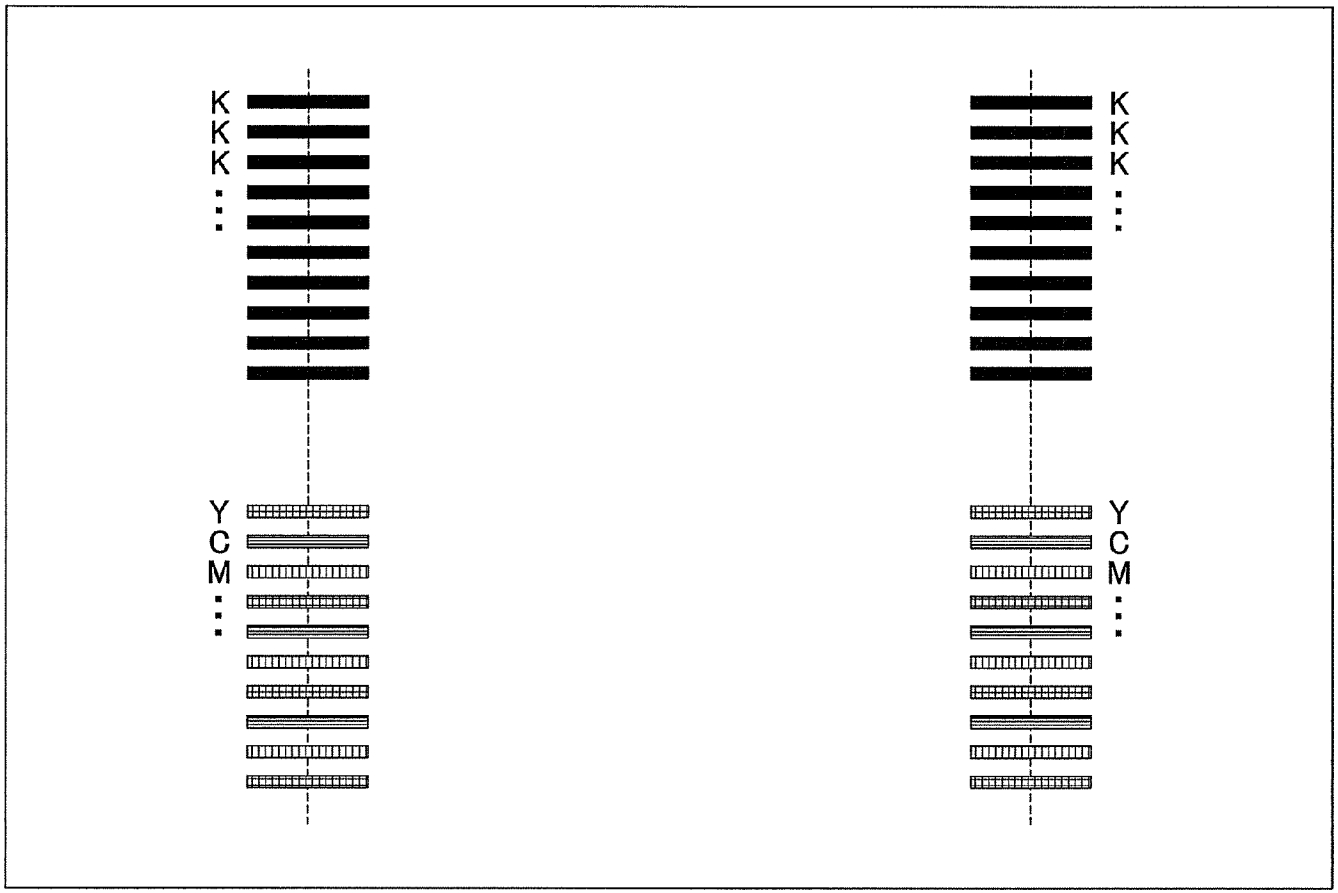
FIG. 6 is a view showing an example of a second belt velocity detecting toner pattern of the embodiment of the present invention.

FIG. 6 is a view showing an example of a second belt velocity detecting toner pattern of the embodiment of the present invention. FIG. 6 shows an example of a belt velocity detecting toner pattern where the toner pattern of the black color and the toner pattern of plural chromatic colors are provided with a designated gap in a continuing position in the belt conveyance direction.

As shown in FIG. 6, after the designated number of the horizontal toner patterns K, K, K, . . . of the black color is output, the designated number of the horizontal toner patterns of plural chromatic colors, for example, Y, C, M, is output with a designated gap in the continuing position, so that the second belt velocity detecting toner pattern is formed.

That is, the second belt velocity detecting toner pattern is formed as follows. The toner pattern of the black color and the toner pattern of plural chromatic colors are formed in a continuing position in the belt conveyance direction on one of the intermediate transferring belt 4 and the conveyance belt 6. A designated gap in then belt conveyance direction is provided between the toner pattern of the black color and the toner pattern of plural chromatic colors formed in the continuing position.

At this time, even if there is the velocity difference between the intermediate transferring belt 4 and the conveyance belt 6, in the second belt velocity detecting toner pattern formed by the toner patterns of the belts, a designated gap in the conveyance direction is provided between the toner pattern of the black color and the toner pattern of plural chromatic colors.

Accordingly, without overlapping the toner pattern of the black color and the toner pattern of plural chromatic colors, it is possible to precisely detect the position of the toner pattern by the toner mark sensor 20. Because of this, the velocity difference between two belts can be precisely detected so that the velocity adjustment can be made precisely.

<Example of Third Belt Velocity Detecting Toner Pattern>

Figure 7:
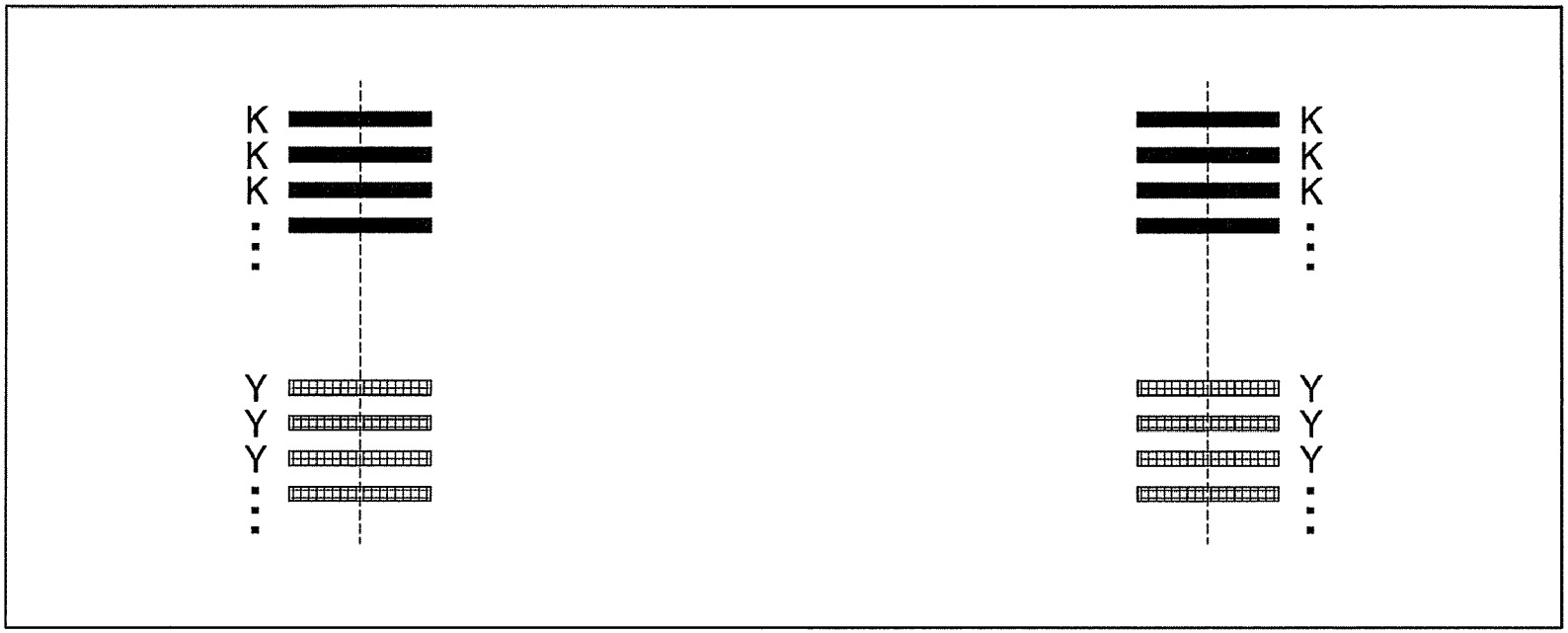
FIG. 7 is a view showing an example of a third belt velocity detecting toner pattern of the embodiment of the present invention.

FIG. 7 is a view showing an example of a third belt velocity detecting toner pattern of the embodiment of the present invention. FIG. 7 shows an example of a belt velocity detecting toner pattern formed by the toner pattern of the black color and the toner pattern of a single chromatic color among plural chromatic colors.

As shown in FIG. 7, on the intermediate transferring belt 4 or the conveyance belt 6, after the designated number of the horizontal toner patterns K, K, K, . . . of the black color is output, the designated number of the horizontal toner patterns of a single chromatic color among plural chromatic colors, for example, Y, Y, Y, is output with a designated gap, so that the third belt velocity detecting toner pattern is formed.

In the third belt velocity detecting toner pattern, a toner pattern is formed by a toner of a single chromatic color among plural chromatic colors. Therefore, in the third belt velocity detecting toner pattern compared to the second belt velocity detecting toner pattern, it is possible to reduce the time for forming the toner pattern of the chromatic color.

Accordingly, in the third belt velocity detecting toner pattern compared to the second belt velocity detecting toner pattern, since it is possible to form the toner pattern more quickly, it is possible to immediately detect the velocity difference of the belts.

As discussed above, in the second and third belt velocity detecting toner patterns, one of the toner pattern of the chromatic color output on the intermediate transferring belt 4 and the toner pattern of the black color output on the conveyance belt 6 is transferred on the other of the intermediate transferring belt 4 and the conveyance belt 6, and the belt velocity detecting toner pattern is formed on this other belt.

At this time, since a designated gap in the belt conveyance direction is provided between the toner pattern of the chromatic color and the toner pattern of the black color, when transferring a toner pattern onto the other belt, the toner pattern of the chromatic color and the toner pattern of the black color are not overlapped. Therefore, it is possible to precisely detect the velocity difference between the belts.

Furthermore, in the third belt velocity detecting toner pattern compared to the second belt velocity detecting toner pattern, it is possible to reduce the time for forming the toner pattern of the chromatic color.

<Example of Fourth Belt Velocity Detecting Toner Pattern>

Figure 8:
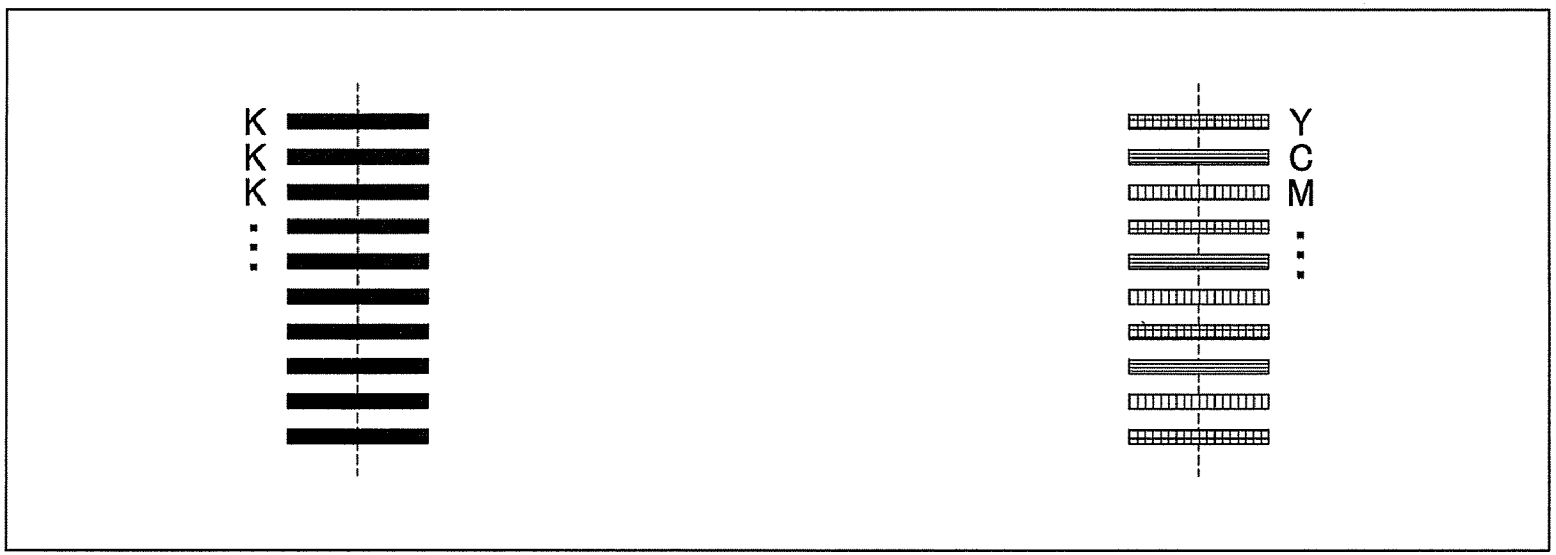
FIG. 8 is a view showing an example of a fourth belt velocity detecting toner pattern of the embodiment of the present invention.

FIG. 8 is a view showing an example of a fourth belt velocity detecting toner pattern of the embodiment of the present invention. FIG. 8 shows an example of a belt velocity detecting toner pattern formed by the toner pattern of the black color and the toner pattern of plural chromatic colors which are formed in parallel with the belt conveyance direction.

In the related art color matching process, in order to adjust magnification in the main scanning direction so as to perform color matching, the toner pattern is output at a write staring side and a write ending side in the main scanning direction. Corresponding to this, for example, two toner toner mark sensors 20*a* are arranged at the write staring side and the write ending side in the main scanning direction.

Therefore, as shown in FIG. 8, the horizontal toner patterns of the black color K, K, K, . . . are output at the write starting side of the toner mark on the conveyance belt 6 and the horizontal toner patterns of the plural chromatic color Y, C, M, . . . are output at the write ending side of the toner mark on the conveyance belt 6, so that the fourth belt velocity detecting toner pattern is formed.

In other words, in the fourth belt velocity detecting toner pattern, the toner pattern of the black color and the toner pattern of plural chromatic colors are provided in different positions in the main scanning direction, for example in parallel (parallel with the belt conveyance direction). Therefore, the toner mark sensor 20*a* can detect, at the same timing, the toner pattern of the black color and the toner pattern of plural chromatic colors.

Even if there is the velocity difference between the intermediate transferring belt 4 and the conveyance belt 6, the toner pattern of the black color and the toner pattern of plural chromatic colors are formed in parallel with the belt conveyance direction in the fourth belt velocity detecting toner pattern.

Therefore, when one of the toner pattern of the black color and the toner pattern of plural chromatic colors is transferred to the other belt, the toner pattern of the black color and the toner pattern of plural chromatic colors are not overlapped. Hence, the position of the toner pattern is precisely detected and therefore it is possible to detect the velocity difference of the belts precisely.

In the fourth belt velocity detecting toner pattern compared to the second and third belt velocity detecting toner patterns, it is not necessary to provide a designated gap in the belt conveyance direction. Therefore, it is possible to reduce a time for forming the toner pattern. Accordingly, it is possible to reduce the belt velocity detecting time.

<Example of Fifth Belt Velocity Detecting Toner Pattern>

Figure 9:
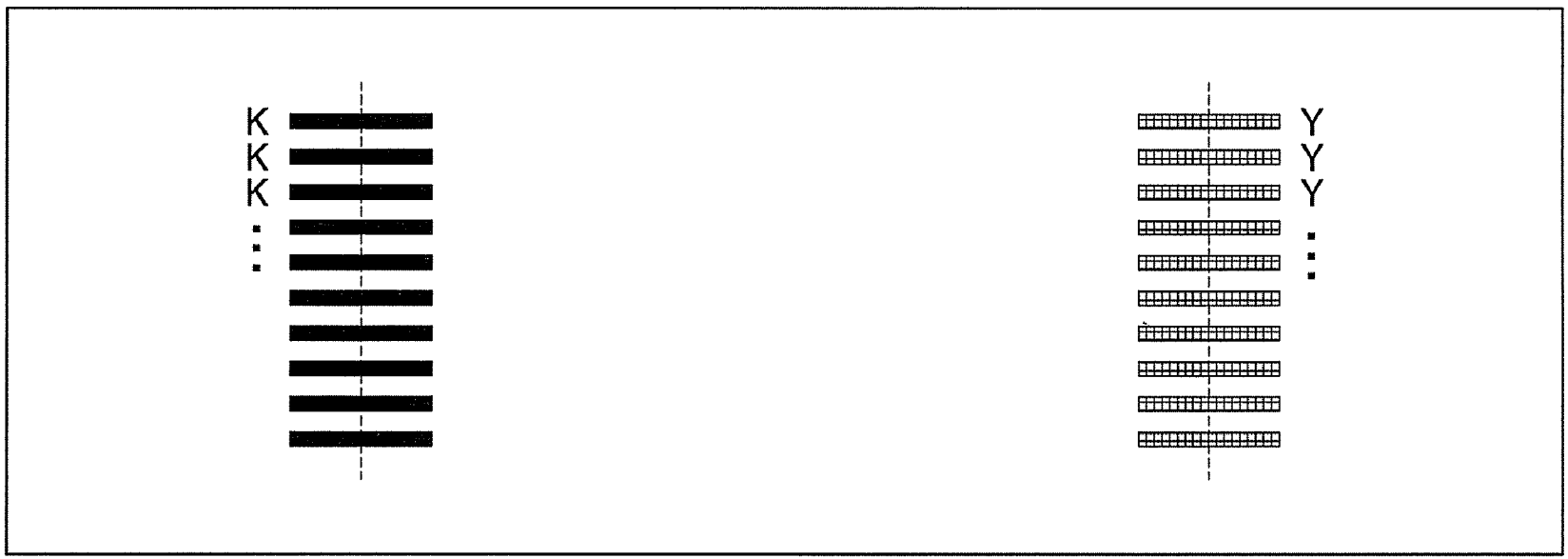
FIG. 9 is a view showing an example of a fifth belt velocity detecting toner pattern of the embodiment of the present invention.

FIG. 9 is a view showing an example of a fifth belt velocity detecting toner pattern of the embodiment of the present invention. FIG. 9 shows an example of the belt velocity detecting toner pattern formed by the toner pattern of the black color and the toner pattern of a single chromatic color among plural chromatic colors.

As shown in FIG. 9, the designated number of the horizontal toner patterns K, K, K, . . . of the black color and the designated number of the horizontal toner patterns of a single chromatic color among plural chromatic colors, for example, Y, Y, Y, are output so as to be formed in parallel with the conveyance direction of the conveyance belt 6, so that the fifth belt velocity detecting toner pattern is formed.

While the fourth belt velocity detecting toner pattern is formed by the toner patterns of plural chromatic colors, the fifth belt velocity detecting toner pattern is formed by the toner pattern by a single chromatic color.

Accordingly, in the fifth belt velocity detecting toner pattern compared to the fourth belt velocity detecting toner pattern, a time for forming the toner pattern of the chromatic color can be reduced more and the amount of toner to be used can be reduced more. In addition, it is possible to immediately detect the velocity difference of the belts.

In the third or fifth belt velocity detecting toner pattern, in a case where only a single chromatic color among plural colors is used, for example, if yellow situated at a most downstream side of the intermediate transferring belt 4 (most forward in the conveyance direction) is used in the toner image forming part 1 provided, it is possible to further reduce the time for forming the toner pattern.

In order to detect the belt velocity of the conveyance belt 6 by the toner pattern of the black color and the belt velocity of the intermediate transferring belt 4 by the toner pattern of the chromatic color, for example, at least two toner marks may be formed. As a result of this, it is possible to reduce the time for forming the toner pattern and immediately detect the belt velocities of the belts.

<Belt Velocity Detecting Toner Pattern Formed on the Intermediate Transferring Belt>

The above-discussed belt velocity detecting toner pattern may be formed on the intermediate transferring belt 4 and may be detected by the toner mark sensor 20*b* provided in a position facing the intermediate transferring belt 4.

In a case where the belt velocity detecting toner pattern is formed on the intermediate transferring belt 4, a bias which is reverse of the bias applied in the case of transferring onto a normal sheet is applied by the secondary transferring part so that the toner pattern of the black color transferred on the conveyance belt 6 can be transferred onto the intermediate transferring belt 4.

As a result of this, the toner pattern of the black color is transferred onto the intermediate transferring belt 4, so that the belt velocity detecting toner pattern where the toner pattern of the black color and the toner pattern of the chromatic color are provided on the intermediate transferring belt 4 can be formed.

The belt velocity detecting toner pattern to be formed on the intermediate transferring belt 4 is formed by transferring the toner pattern of the black color onto the conveyance belt 6 and then transferring it onto the intermediate transferring belt 4. Since contrast of the toner pattern of the black color is higher than that of the toner pattern of the chromatic color, reproducibility of the toner pattern in this case is better that that in a case where a toner mark of each of the chromatic colors is transferred onto the conveyance belt 6.

Accordingly, in this case, precision of reading by the toner mark sensor 20*b* can be improved.

Furthermore, it is possible to shorten the velocity detecting time by detecting the velocity of the intermediate transferring belt 4, during outputting only the monochrome image, by using the toner pattern of the chromatic color formed on the intermediate transferring belt 4.

In addition, a cleaning part used at the intermediate transferring belt 4 side is stronger than the cleaning part used for the conveyance belt 6. Therefore, it is possible to efficiently remove the toner pattern of plural chromatic colors formed on the intermediate transferring belt 4.

<Example of Toner Pattern for Color Matching Process>

Figure 10:
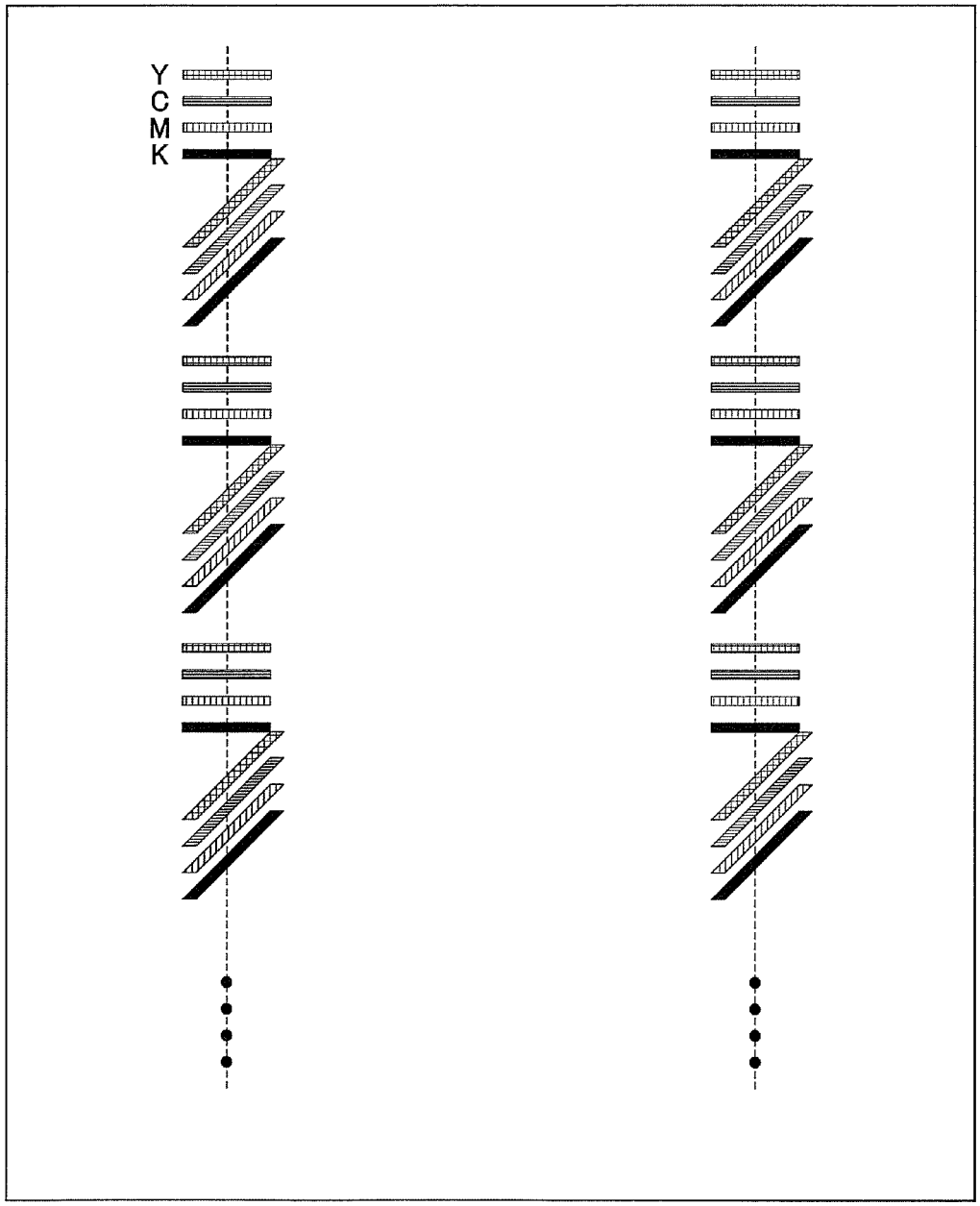
FIG. 10 is a view showing an example of toner patterns for a color matching process of the embodiment of the present invention.

Here, a toner pattern for a color matching process of the embodiment is discussed. FIG. 10 is a view showing an example of the toner pattern for the color matching process of the embodiment of the present invention.

As shown in FIG. 10, the toner pattern used for the color matching process is output where toner patterns of four colors (Y, C, M, K) are repeatedly and closely arranged with a certain gap in the sub-scanning direction as a horizontal toner pattern and a oblique toner pattern. The output toner pattern for the color matching process is formed along a moving direction (conveyance direction) of the intermediate transferring belt 4 or the conveyance belt 6 on the intermediate transferring belt 4 or the conveyance belt 6.

In this embodiment, the velocity difference between intermediate transferring belt 4 and the conveyance belt 6 may be detected by using, as the belt velocity detecting toner pattern, the toner pattern of the chromatic color and the toner pattern of the black color among the horizontal toner patterns of the color matching process toner pattern. As a result of this, it is possible to shorten the time for preparing the belt velocity detecting toner pattern in the belt velocity adjusting process.

<Flow of Belt Velocity Adjusting Process and Color Matching Process>

Figure 11:
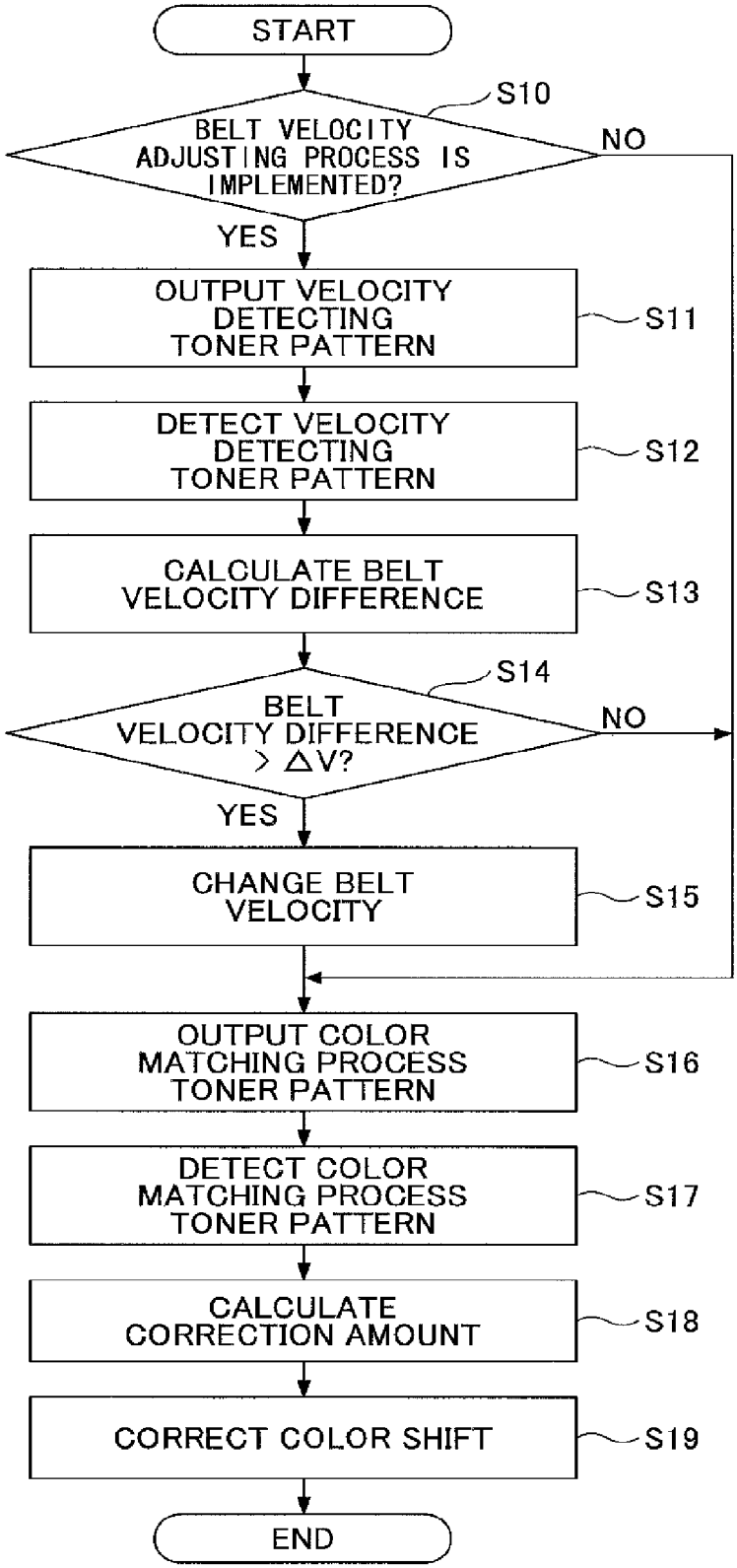
FIG. 11 is a flowchart showing a flow of a belt velocity adjusting process and the color matching process.

Next, a belt velocity adjusting process and a color matching process are discussed with reference to FIG. 11. FIG. 11 is a flowchart showing flow of the belt velocity adjusting process and the color matching process.

In this embodiment, prior to the color matching process, the belt velocity adjusting process of the intermediate transferring belt 4 and the conveyance belt 6 is implemented.

As shown in FIG. 11, the CPU 30 determines whether the belt velocity adjusting process is implemented, in step S10. If the belt velocity adjusting process is implemented, it will take a long time for the color matching process and usefulness of the user may be degraded. Accordingly, if designated conditions described below are satisfied, the belt velocity adjusting process is implemented.

If the belt velocity adjusting process is not implemented (NO in step S10), the color matching process is implemented in and after step S16.

If the belt velocity adjusting process is implemented (YES in step S10), the plotter 36 outputs the belt velocity detecting toner pattern (S11).

Next, the toner mark sensor 20*a* detects the belt velocity detecting toner pattern formed on the conveyance belt 6 in step S12.

As the belt velocity detecting toner pattern formed on the conveyance belt 6, for example, the horizontal toner pattern of one of the first through fifth belt velocity detecting toner patterns shown in FIG. 4 and FIG. 6 through FIG. 9 or the color matching process toner pattern shown in FIG. 10 is used.

Based on information of the toner pattern detected in step S12, the velocity difference detecting part 38 calculates the velocities of the intermediate transferring belt 4 and the conveyance belt 6 so as to calculate the velocity difference between the intermediate transferring belt 4 and the conveyance belt 6 in step S13.

As discussed above, the velocity of each of the belts is calculated in the following way. A time $\Delta T$ is measured when two of the toner patterns made of the same color toner marks, among the toner patterns formed on the conveyance belt 6, pass the toner mark sensor 20*a*. An output pattern interval $\Delta(Y_n - Y_0)$ set in advance is divided by the passing time $\Delta T$, so that the velocity of each of the belts is calculated.

For example, a velocity V1 of the intermediate transferring belt 4 is calculated by using the toner pattern of the chromatic color (the toner pattern of the yellow color) in the belt velocity detecting toner pattern. A velocity V2 of the conveyance belt 6 is calculated by using the toner pattern of the black color. After that, the belt velocity difference (V1−V2) at the belt driving time is calculated based on the difference of the velocity V1 of the intermediate transferring belt 4 and the velocity V2 of the conveyance belt 6.

In a case where the toner pattern of the chromatic color and the toner pattern of the black color are set to have the same gap, the belt velocity difference may be calculated by comparing a passing time for two toner marks of the toner pattern of the chromatic color and a passing time for two toner marks of the toner pattern of the black color.

Next, the determining part 39 determined whether the belt velocity difference of the intermediate transferring belt 4 and the conveyance belt 6 calculated in step S13 is equal to or greater than a designated value (ΔV) set in advance in step S14.

Here, the designated value set in advance is, as discussed above, a value corresponding to the velocity difference whereby the color shift amount due to the belt velocity difference is equal to or less than the color shift amount acceptable in the output image. The designated value set in advance is set based on the velocity difference between the actual velocity and a designated object velocity being set for the intermediate transferring belt 4 and the conveyance belt 6 is in a certain range (such as equal to less than 0.05%).

In a case where the velocity difference of the belts is lower than the designated value (ΔV) (NO in step S14), the determining part 39 determines that the color shift based on the belt velocity difference between the intermediate transferring belt 4 and the conveyance belt 6 is lower than an acceptable amount so that the process goes to a normal color matching process in or after step S16.

In a case where the velocity difference of the belts is equal to or greater than the designated value (ΔV) (YES in step S14), the velocity adjusting part 40 adjusts (changes) the velocity of the intermediate transferring belt 4 or the conveyance belt 6 so that the belt velocity difference is cancelled and the velocity of the intermediate transferring belt 4 and the velocity of the conveyance belt 6 are consistent with each other in step S15. The way of the belt velocity adjusting method is discussed below.

After the process in step S15, the CPU implements a color matching process. The process in or after step S16 is a known color matching process.

First, in step S16, the plotter 36 outputs the detecting toner pattern for detecting the color shift amount among colors to the intermediate transferring belt 4 and the conveyance belt 6 whose velocities have been adjusted in step S15. The toner mark sensor 20*b* detects the color matching detecting toner pattern transferred onto the conveyance belt 6 in step S17.

Next, from edge information of the toner pattern detected in step S17, skew, a shift amount in a main scanning direction, and a shift amount in a sub-scanning direction are calculated so that a correction amount for a shift between the colors is calculated in step S18.

Next, a color matching correction part 42 makes an output in which the calculated correction amount is reflected when an image is output after this process. Thus, the color shift is corrected in step S19 and the process ends.

In step S17, the same process as the process of step S13 may be performed by using the horizontal toner pattern in the color matching toner pattern, and the velocity difference between the intermediate transferring belt 4 and the conveyance belt 6 may be calculated, thereby whether the result of the belt velocity adjusting process performed in step S15 is correct may be simultaneously determined.

Here, conditions for determining whether the belt velocity adjusting process is to be implemented in step S10 are discussed. The belt velocity adjusting process can be performed every time before the color matching process is performed. However, in this case, it may take a long time for the color matching process and the usefulness of the user may be degraded. Therefore, the belt velocity adjusting process may be performed only when the designated conditions are satisfied.

More specifically, in a case where the intermediate transferring units 3Y, 3C, 3M or the direct transferring unit 5K is exchanged when a designated number of sheets have been output, since the velocity of the intermediate transferring belt 4 or the conveyance belt 6 may possibly have changed, the belt velocity adjusting process may be performed. In addition, the passing time from the last belt velocity adjusting time or the number of output sheets is measured so that the belt velocity adjusting process may be performed when a designated time passes or a designated number of sheets have been output.

In a case where the atmospheric conditions have changed, the velocity of each of the belts may possibly have changed, based on the change of the diameter of the driving roller 11 or 13 configured to drive the intermediate transferring belt 4 or the conveyance belt 6 or the change of properties of the intermediate transferring belt 4 or the conveyance belt 6.

Accordingly, a temperature sensor or a moisture sensor (not illustrated) may be used so that the belt velocity adjusting process may be performed only when the temperature or moisture is changed so as to have a value equal to or greater than a designated value from the last belt velocity adjusting time or color matching process time.

<Belt Velocity Adjusting Method>

Next, the velocity adjusting method implemented in step S15 is discussed. The velocity adjusting part 40, in step S15, cancels the belt velocity difference calculated in step S13 and adjusts the velocities of the intermediate transferring belt 4 and the conveyance belt 6 so as to be consistent with each other.

For example, the velocity adjusting part 40 performs the velocity adjustment of the intermediate transferring belt 4 or the conveyance belt 6 by transmitting a signal for controlling a rotational speed of the corresponding motor 44 to the motor control part 41. The motor control part 41 controls the rotational speeds of the motors 44 connected to the driving roller 11 of the intermediate transferring belt 4 and the driving roller 13 of the conveyance belt 6.

More specifically, the velocity adjusting part 40 changes the clock frequency for determining the rotational speed of one of the motors 44, the clock frequency being supplied to the motor 44 by the motor control part 41, so as to change the velocity of one of the belts.

For example, the velocity adjusting part 40 obtains a clock frequency Δf which is a clock number per unit time corresponding to the velocity difference ΔA which is "the belt velocity of the intermediate transferring belt 4" minus "the belt velocity V2 of the conveyance belt 6".

Figure 12:
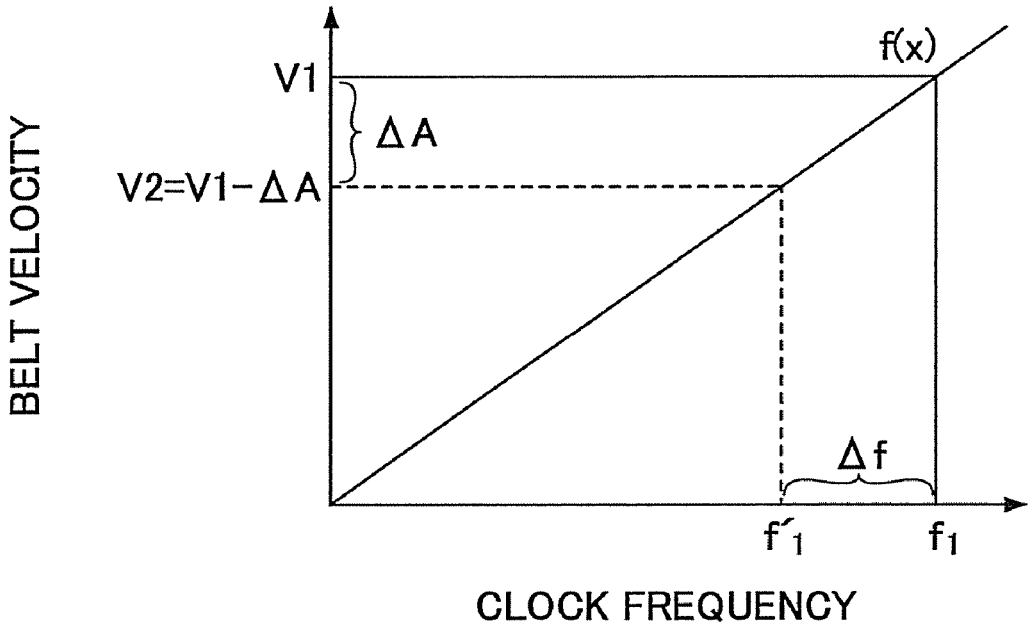
FIG. 12 is a graph showing relationship between a belt velocity and a clock frequency.

FIG. 12 is a graph showing the relationship between the belt velocity and the clock frequency. In the graph, a vertical axis represents the belt velocity and a horizontal axis represents the clock frequency. As shown in FIG. 12, when the clock frequency is $f_1$, the belt velocity is V1. When the clock frequency is $f_{1'}$, the belt velocity is V2. The belt velocity V is proportional to the clock frequency f.

In other words, the following formulas are formed.

$$f_1 = f(V1)$$

$$f_1' = f(V1 - \Delta A).$$

As shown in FIG. 12, the following formula is formed.

$$f_1' = f_1 - \Delta f$$

Therefore, for example, in a case where a clock frequency provided by the motor control part 41 to the motor 44 of the intermediate transferring belt 4 is $f_1$, the velocity adjusting part 40 transmits a control signal whereby the clock frequency $f_1$ of the intermediate transferring belt 4 is changed to a clock frequency $f_1'$ which is "$f_1-\Delta f$" by using a clock frequency $\Delta f$ corresponding to the velocity difference $\Delta A$.

As a result of this, the motor control part 41 cancels the velocity difference between the intermediate transferring belt 4 and the conveyance belt 6 by providing the clock frequency $f_1'$ to the motor 44 of the intermediate transferring belt 4. Because of this, the velocity of the intermediate transferring belt 4 is consistent with the velocity of the conveyance belt 6.

Although it is preferable to adjust the speeds of the motors 44 configured to drive the intermediate transferring belt 4 and the conveyance belt 6 to have proper values, if the velocity of the conveyance belt 6 is changed, the relationship between the sheet feeding and sheet discharging may be changed.

Accordingly, the velocity of the conveyance belt 6 may be fixed and the velocity of the intermediate transferring belt 4 may be adjusted to the velocity of the conveyance belt 6.

As discussed above, according to the embodiment of the present invention, the belt speed detecting toner pattern formed on the belt used for image forming is used. Hence, the velocity difference between the intermediate transferring belt and the conveyance belt is precisely and immediately detected under conditions similar with image forming conditions. After the velocity of the belt is adjusted so that the velocity difference between the two belts becomes less than a designated value, the color matching process is performed. Therefore, it is possible to precisely perform the color matching between the colors.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that the various changes, substitutions, and alterations could be made hereto without departing from the spirit and scope of the invention.

What is claimed is:

1. An image forming apparatus, comprising:

a transferring belt where a color image is formed;

a conveyance belt configured to transfer a recording medium where a monochrome image is transferred;

a velocity difference detecting part configured to detect a velocity difference between the transferring belt and the conveyance belt;

a determining part configured to determine whether the velocity difference detected by the velocity difference detecting part is equal to or greater than a designated value;

a velocity adjusting part configured to adjust the velocity difference so that the velocity difference becomes lower than the designated value in a case where the velocity difference is determined to be the designated value or more by the determining part; and a color correcting part configured to correct a shift of colors between the color image and the monochrome image by using the transferring belt and the conveyance belt whose velocities are adjusted by the velocity adjusting part.

2. The image forming apparatus, as claimed in claim 1, wherein the velocity difference detecting part is configured to detect the velocity difference by using a velocity detecting toner pattern formed, by a toner image forming part, on one of the transferring belt and the conveyance belt.

3. The image forming apparatus, as claimed in claim 2, wherein the velocity detecting toner pattern includes a toner pattern of at least one chromatic color among plural chromatic colors forming the color image, and a toner pattern of a black color forming the monochrome image.

4. The image forming apparatus, as claimed in claim 3, wherein the toner pattern of the chromatic color and the toner pattern of the black color are formed so as not to be overlapped.

5. The image forming apparatus, as claimed in claim 3, wherein the toner pattern of the chromatic color and the toner pattern of the black color are formed in parallel with a conveyance direction of the transferring belt or the conveyance belt.

6. The image forming apparatus, as claimed in claim 3, wherein the toner pattern of the chromatic color and the toner pattern of the black color are formed in a position continuing in a conveyance direction of the transferring belt or the conveyance belt; and a designated gap in the conveyance direction is provided between the toner pattern of the chromatic color and the toner pattern of the black color formed in the continuing position.

7. The image forming apparatus, as claimed in claim 3, wherein the toner pattern of the chromatic color is formed by a toner image forming part provided most downstream of the transferring belt.

8. The image forming apparatus, as claimed in claim 3, wherein the toner pattern of the chromatic color is formed on the transferring belt when only the monochrome image is formed.

9. The image forming apparatus, as claimed in claim 3, wherein the velocity difference detecting part is configured to detect the velocity difference by using, as the velocity detecting toner pattern, the toner pattern of the chromatic color and the toner pattern of the black color among horizontal color matching process toner patterns formed on the transferring belt or the conveyance belt.

10. The image forming apparatus, as claimed in claim 1, wherein the velocity adjusting part is configured to adjust the velocity of the transferring belt to the velocity of the conveyance belt.

11. An image forming method implemented by using an image forming apparatus, the image forming apparatus including a transferring belt where a color image is formed and a conveyance belt configured to transfer a recording medium where a monochrome image is transferred, the image forming method comprising:

a velocity difference detecting step of detecting velocity difference between the transferring belt and the conveyance belt;

a determining step of determining whether the velocity difference detected in the velocity difference detecting step is equal to or greater than a designated value;

a velocity adjusting step of adjusting the velocity difference so that the velocity difference becomes lower than the designated value in a case where the velocity difference is determined to be the designated value or more in the determining step; and a color correcting step of correcting a shift of colors between the color image and the monochrome image by using the transferring belt and the conveyance belt whose velocities are adjusted in the velocity adjusting step.

12. An image forming program product where a program is stored, the program to be executed by a computer to perform an image forming method implemented by using an image forming apparatus, the image forming apparatus including a transferring belt where a color image is formed and a conveyance belt configured to transfer a recording medium where a monochrome image is transferred, the image forming method comprising:

a velocity difference detecting step of detecting velocity difference between the transferring belt and the conveyance belt;

a determining step of determining whether the velocity difference detected in the velocity difference detecting step is equal to or greater than a designated value;

a velocity adjusting step of adjusting the velocity difference so that the velocity difference becomes lower than the designated value in a case where the velocity difference is determined to be the designated value or more in the determining step; and a color correcting step of correcting a shift of colors between the color image and the monochrome image by using the transferring belt and the conveyance belt whose velocities are adjusted in the velocity adjusting step.

* * * * *